US010245758B2

(12) United States Patent
Zhao et al.

(10) Patent No.: US 10,245,758 B2
(45) Date of Patent: Apr. 2, 2019

(54) INTEGRAL RESCUE ACCESSORY FOR FORCIBLE ENTRY AND CORE DRILL

(71) Applicant: Beijing University of Technology, Beijing (CN)

(72) Inventors: Jing Zhao, Beijing (CN); Jiawei Wu, Beijing (CN); Weijian Hu, Beijing (CN); Nailong Zhang, Beijing (CN)

( * ) Notice: Subject to any disclaimer, the term of this patent is extended or adjusted under 35 U.S.C. 154(b) by 181 days.

(21) Appl. No.: 15/534,689

(22) PCT Filed: Oct. 27, 2016

(86) PCT No.: PCT/CN2016/103472

§ 371 (c)(1),
(2) Date: Jun. 9, 2017

(87) PCT Pub. No.: WO2017/177660

PCT Pub. Date: Oct. 19, 2017

(65) Prior Publication Data

US 2018/0194036 A1 Jul. 12, 2018

(30) Foreign Application Priority Data

Apr. 14, 2016 (CN) ..... 2016 1 0232481

(51) Int. Cl.

| | |
|---|---|
| ***B28D 1/04*** | (2006.01) |
| ***A62B 3/00*** | (2006.01) |
| ***E04G 23/00*** | (2006.01) |
| ***E04G 23/08*** | (2006.01) |

(52) U.S. Cl.

CPC ..... *B28D 1/045* (2013.01); *A62B 3/00* (2013.01); *A62B 3/005* (2013.01); *B28D 1/048* (2013.01); *E04G 23/00* (2013.01); *E04G 23/082* (2013.01)

(58) Field of Classification Search

CPC ..... B28D 1/045; B28D 1/048; B28D 1/042; E04G 23/082; A62B 3/00; A62B 3/005

See application file for complete search history.

(56) References Cited

FOREIGN PATENT DOCUMENTS

| | | | | |
|---|---|---|---|---|
| CN | 101927507 | * | 12/2010 | ..... B23Q 5/26 |
| CN | 101927507 A | | 12/2010 | |
| CN | 104941089 | * | 9/2015 | ..... A62B 99/00 |
| CN | 104941089 A | | 9/2015 | |
| CN | 105804431 A | | 7/2016 | |
| JP | 2007176071 | * | 7/2007 | ..... B28D 1/08 |
| JP | 2007176071 A | | 7/2007 | |

* cited by examiner

*Primary Examiner* — Kipp C Wallace

(57) ABSTRACT

An integral rescue accessory for forcible entry and core drill may include hydraulic wall saws, a rotating platform, and a coring claw. Two hydraulic wall saws are symmetry installed on rotating platform. The wall saws cut linearly with the rotation of rotating platform to open a rectangular tunnel on a reinforced concrete wall or floor. After the cutting process, coring process is finished by the wall saws and claw inclinedly mounted to ensure the security of rescue. The whole accessory is installed on a large engineering machine through a hydraulic joint. The present disclosure can transfer general large mechanical equipment into dedicated large mechanical equipment quickly.

5 Claims, 10 Drawing Sheets

INTEGRAL RESCUE ACCESSORY FOR FORCIBLE ENTRY AND CORE DRILL

CROSS REFERENCE TO RELATED APPLICATION

This application is a national stage application of International application number PCT/CN2016/103472, filed Oct. 26, 2016, titled "integral rescue accessory for forcible entry and core drill," which claims the priority benefit of Chinese Patent Application No. 201610232481.8, filed on Apr. 14, 2016, which is hereby incorporated by reference in its entirety.

TECHNICAL FIELD

The present disclosure relates to a new rescue accessory, and particularly to a mechanical design and hydraulic transmission control system, which belongs to the area of engineering machinery rescue equipment.

BACKGROUND

During the rescue process of the earthquake, when facing architectural ruins with a whole shear wall or large floor, the rescue tunnel cannot be opened by shearing and grasping. It is necessary to use a low-disturbing obstacle breaking method to open a tunnel on the obstacle for people or instrument like a stretcher to get through. Currently used large engineering breaking accessories easily cause a subsequent collapse due to massive working strength and impact. When working on an undefined structure such as ruins, conventional accessories may cause new casualties. Using a circular saw blade to cut reinforced concrete wall and floor linearly can prevent the generation of significant impact. Rectangular rescue tunnel is built fast and safely to form multifunctional low-disturbing obstacle breaking earthquake recuse accessories. Combined a circular saw blade with an engineering machine; the circular saw blade cut fast with little tremor. As for different operation spaces of the rescue environment, there is a need for improving earthquake rescue ability and rescue equipment.

SUMMARY

Embodiments of the present disclosure include opening a rectangular rescue tunnel on a large shear wall or large floor. For the rescue security, a coring device is designed to take out the whole core of concrete, which is cut to prevent victims from being crushed by concrete fallings. A circular saw blade may be used to linearly cut floors and wall of reinforced concrete to open a rescue tunnel, and then claw stretch may be placed into the gap to hold and take out the reinforced concrete. According to an actual requirement of rescue, the present disclosure has drilling and coring functions, which may replace current manual rescue operations. In addition, the present disclosure improves the rescue efficiency and security greatly. A new rescue tool is formed by combining these two functions. Rescue work is finished efficiently through connecting with engineering machine.

The present disclosure includes hydraulic wall saws, a rotating platform, and a coring claw. The hydraulic wall saws are used for cutting reinforced concrete. The angle between the wall saw blade, and a cutting plane normal is 10°, cutting is driven by the hydraulic motor, and the hydraulic cantilever is driven by hydraulic to control the up and down of saw blades. The hydraulic travel motor drives wall saws to forward to realize linear cutting of wall saws, meaning that each side of the rectangular tunnel has been cut. Rotating platform is controlled by a servo motor; it rotates 90° after finishing the cut of one rectangular side by wall saws blade to finish cutting on the next side. When cutting off one rectangular side is finished, the rotating platform rotates 90°. After that, the coring claw is stretched in which can stretch into the kerf exactly. The core is held, after all cutting work is finished, and it is lifted by mechanical arm of engineering machine. Then the core is taken out, and integral tapping and coring operation is finished.

In the present disclosure, there are two saws symmetrical distributed, two hydraulic wall saws working simultaneously to improve the rescue efficiency greatly and to reduce the generation of impact to some extent. Thus, the security of unstable structure of ruins is improved.

The beneficial effects of the present disclosure under safety condition are provided as follow. The rescue tunnel is opened fast and can be connected with general large engineering machine equipment fast. The present disclosure makes a general large engineering machine equipment to be transferred into a dedicated large engineering machine equipment fast in an earthquake rescue spot.

Figure 1:
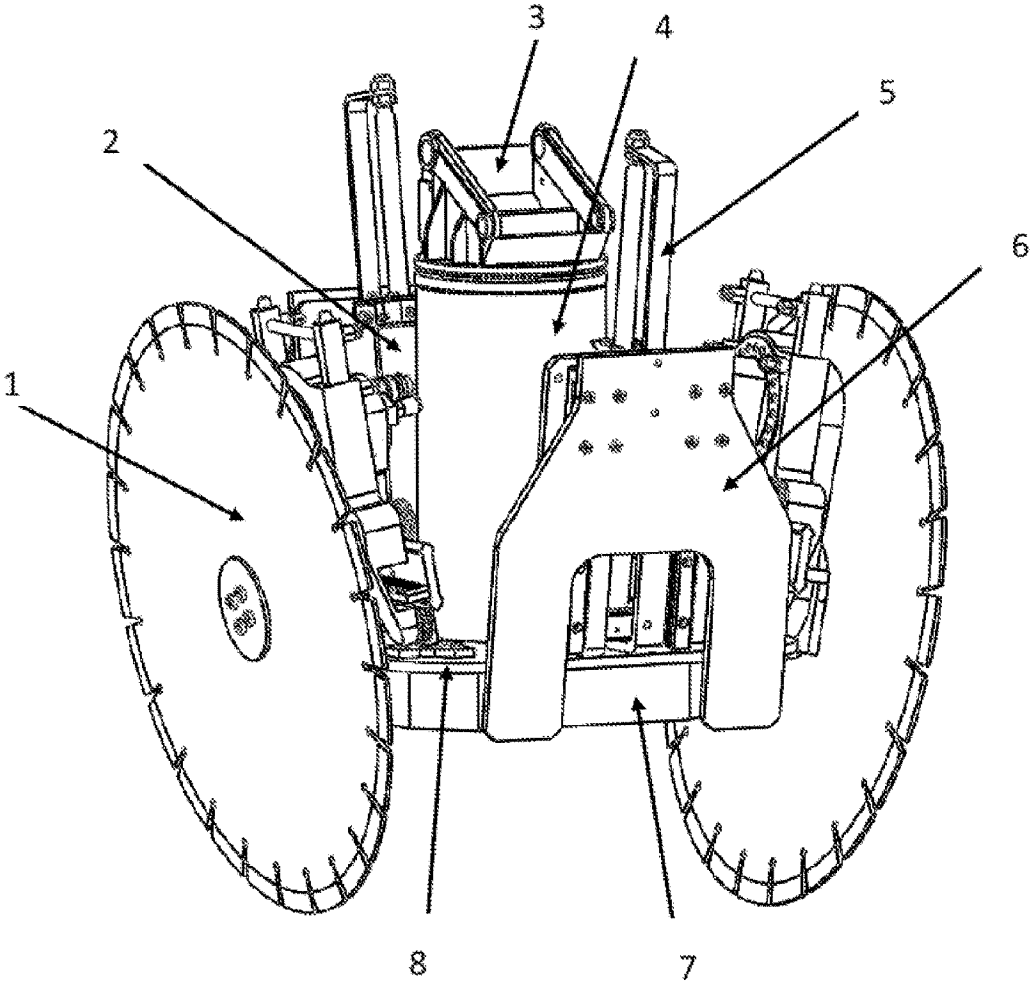
FIG. 1 is a 3-D diagram that illustrates the whole assembly.
Figure 2:
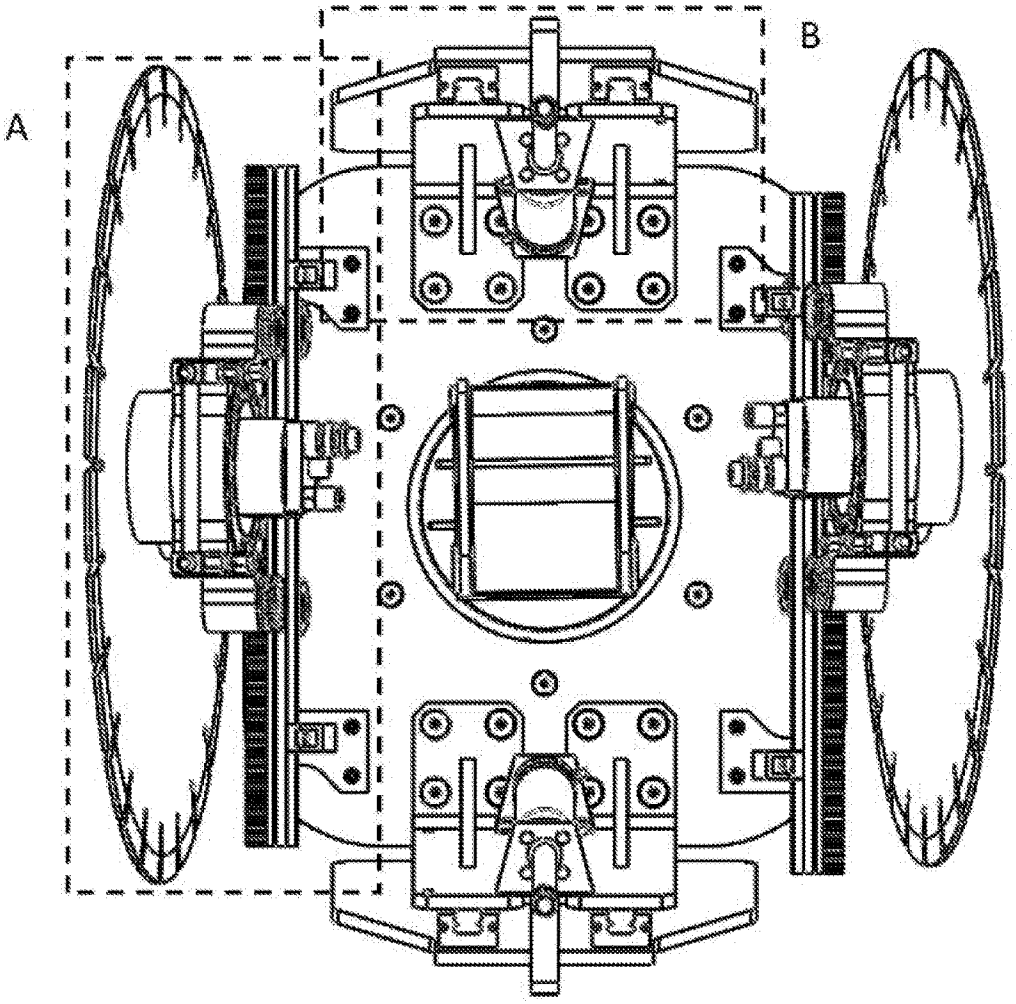
FIG. 2 is a top view of the whole assembly.
Figure 3:
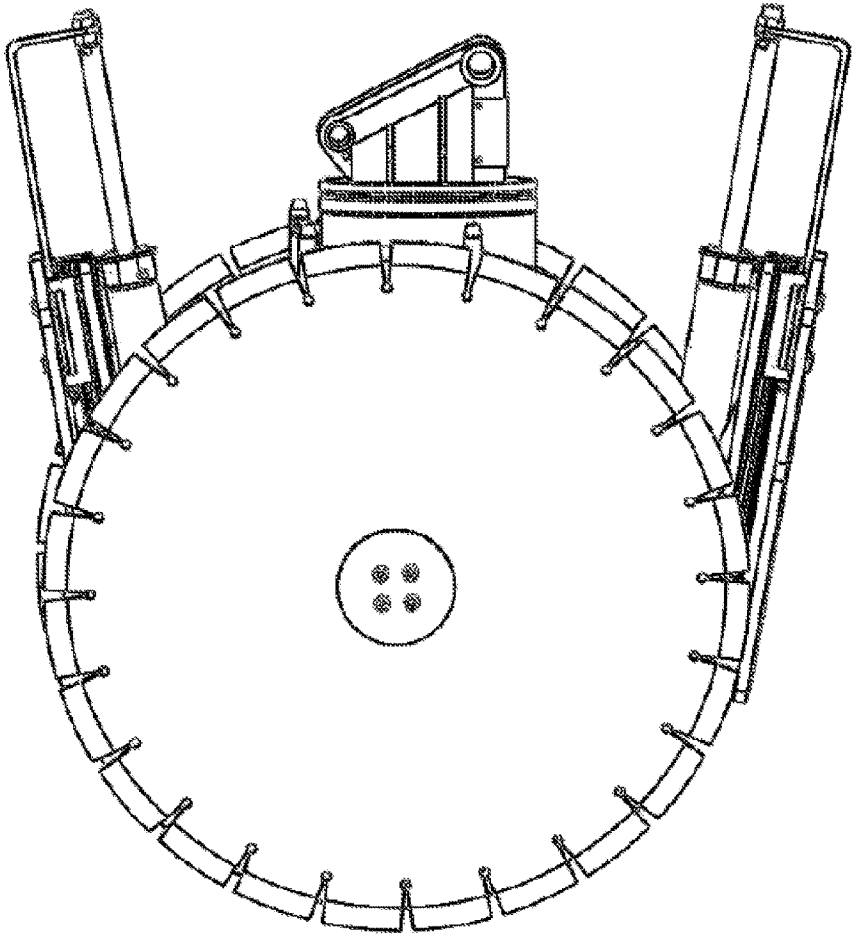
FIG. 3 is a front view of the whole assembly.
Figure 4:
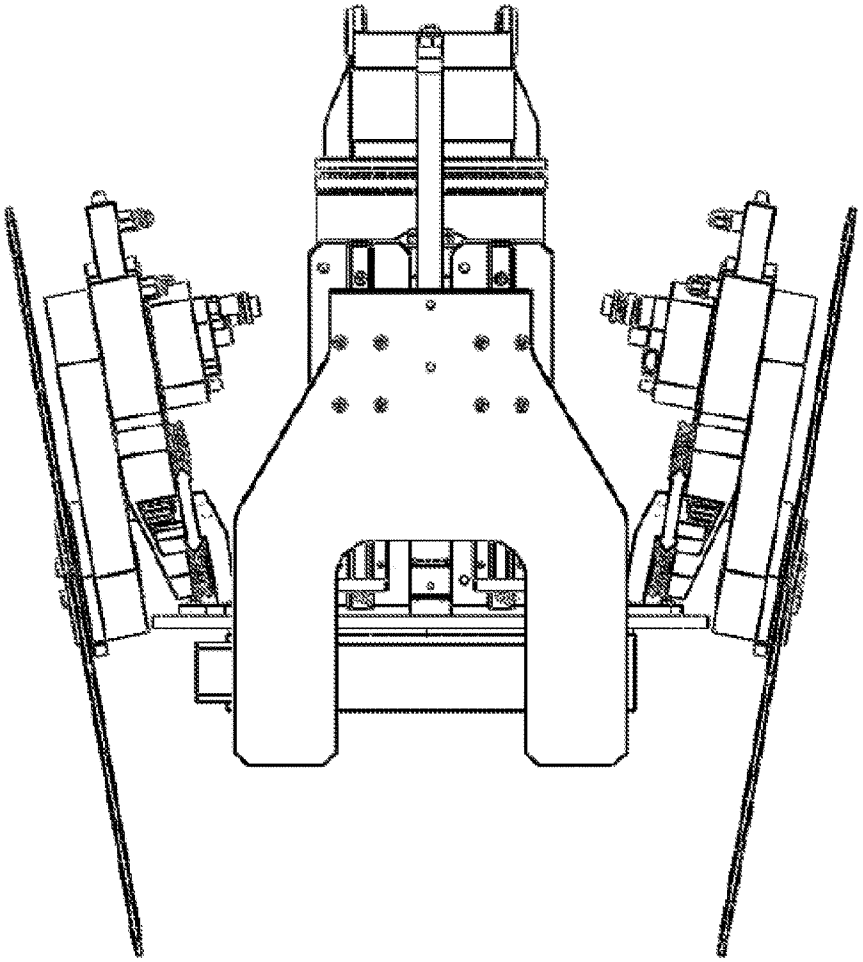
FIG. 4 is a left view of the whole assembly.
Figure 5:
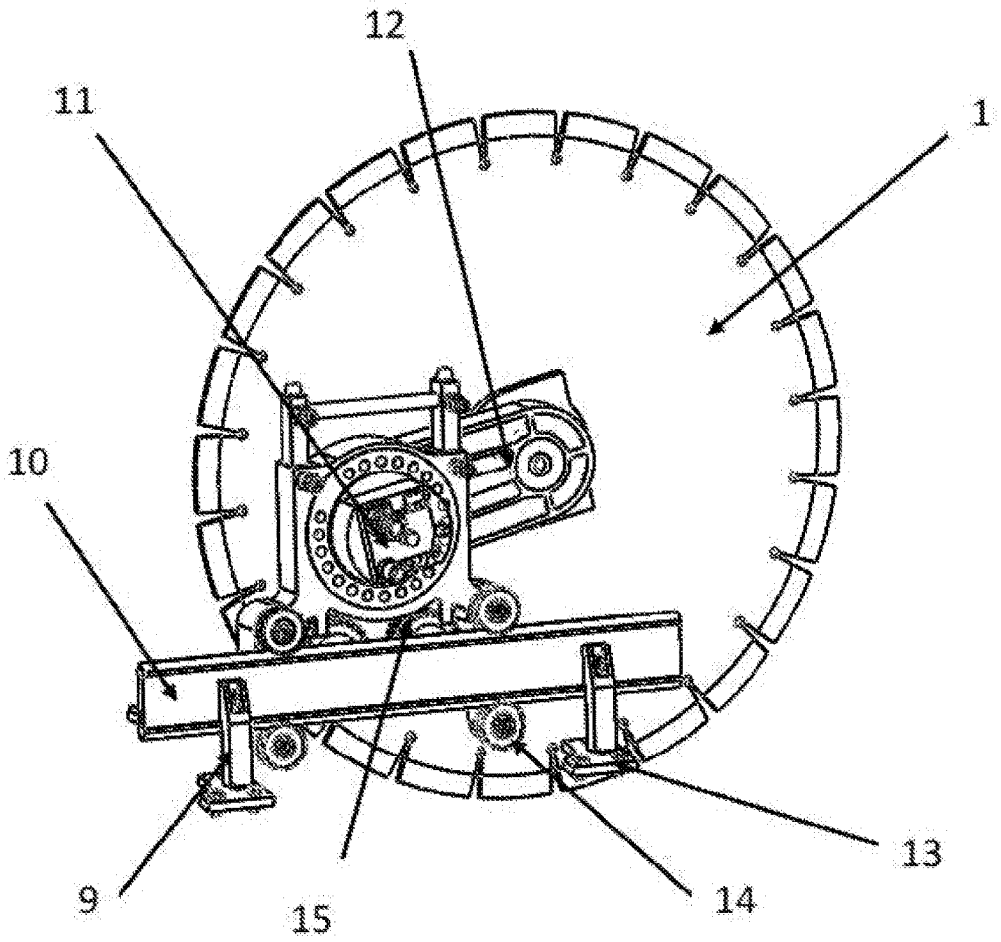
FIG. 5 is a structure chart of a hydraulic wall saw.
Figure 6:
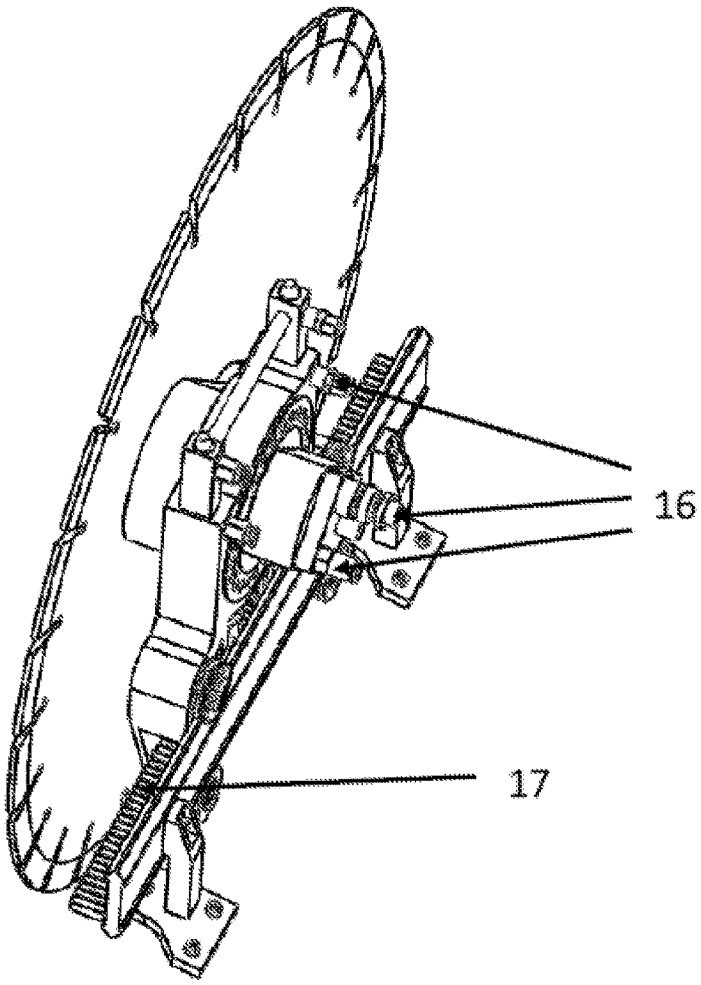
FIG. 6 is a driving view of a hydraulic wall saw.
Figure 7:
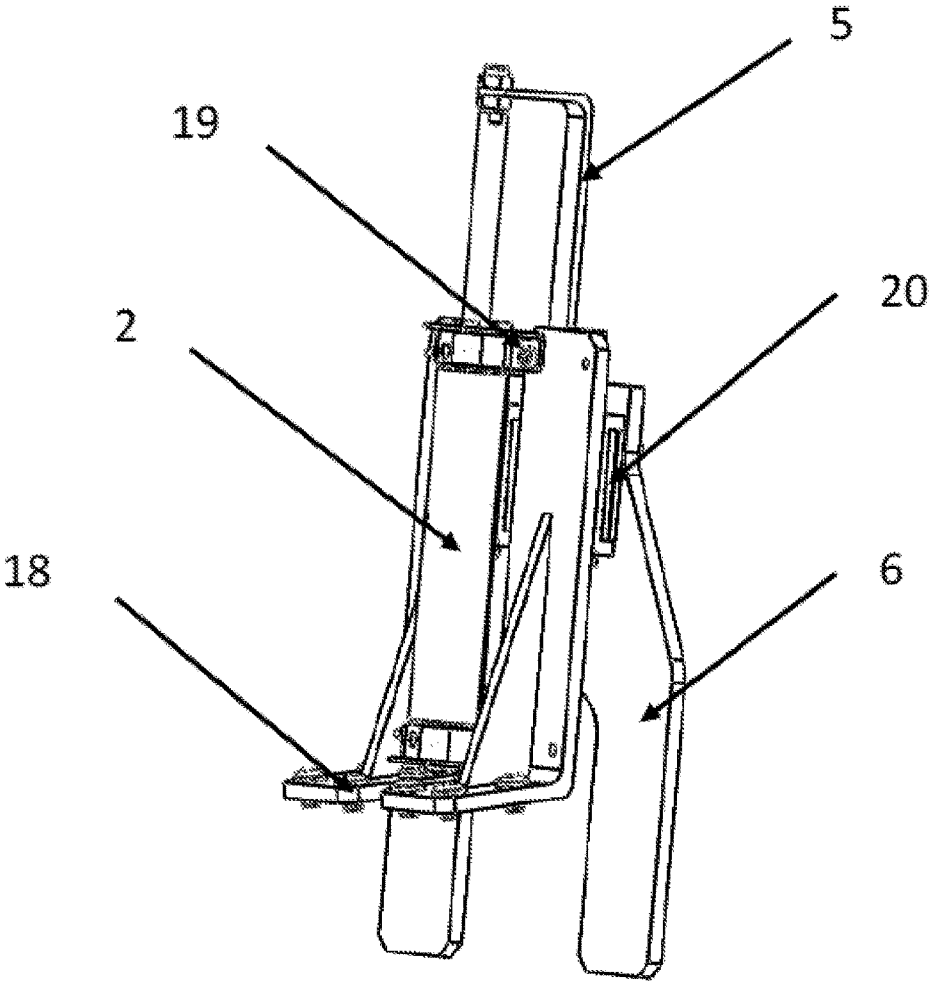
FIG. 7 is a structure chart of a claw.
Figure 8:
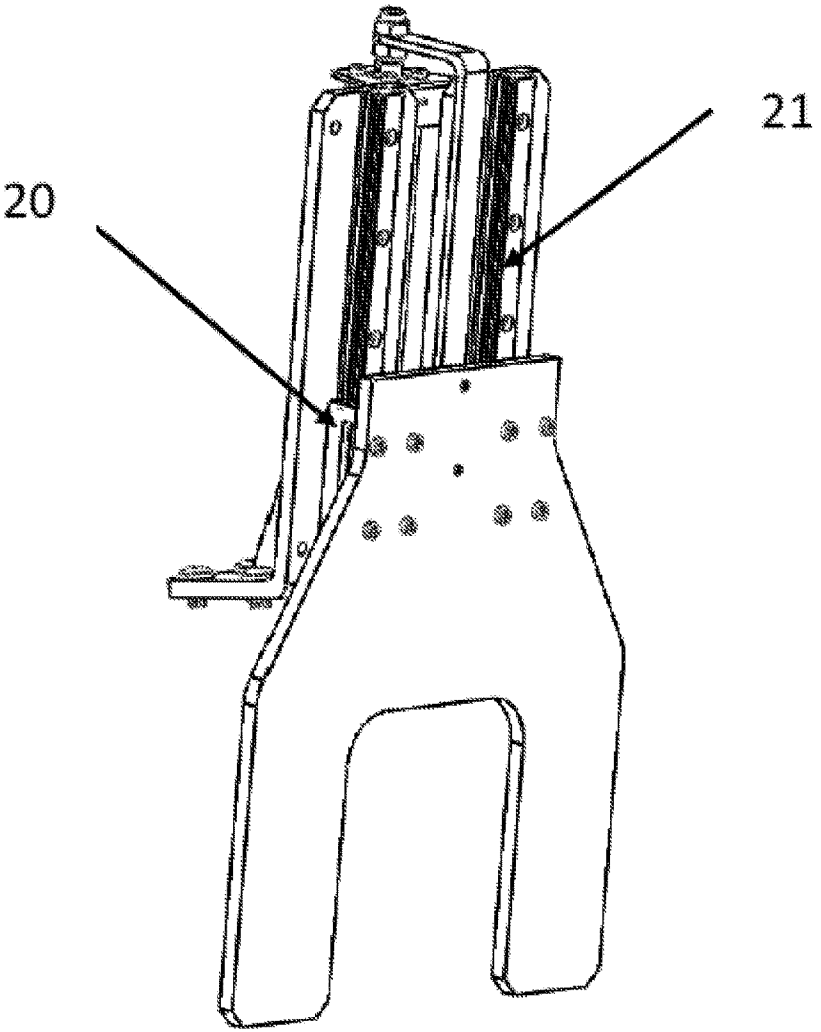
FIG. 8 is an installation view of a claw.
Figure 9:
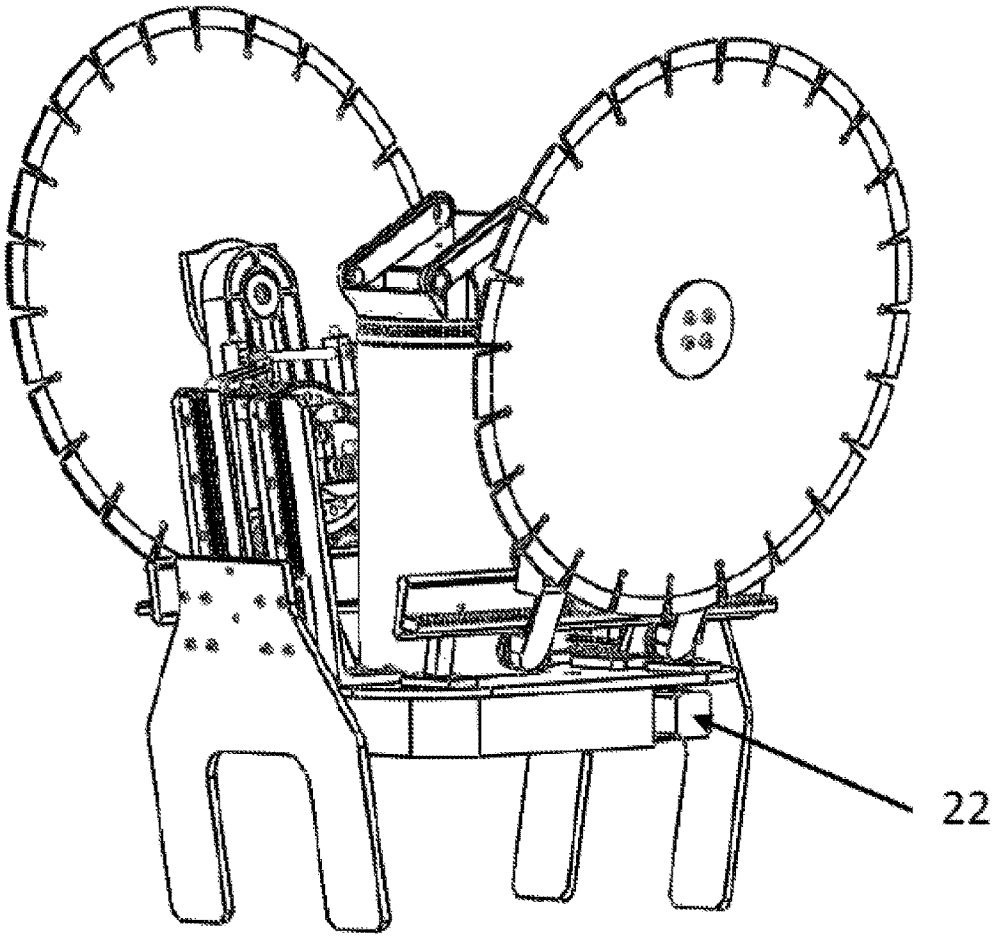
FIG. 9 is an operation view of a claw.
Figure 10:
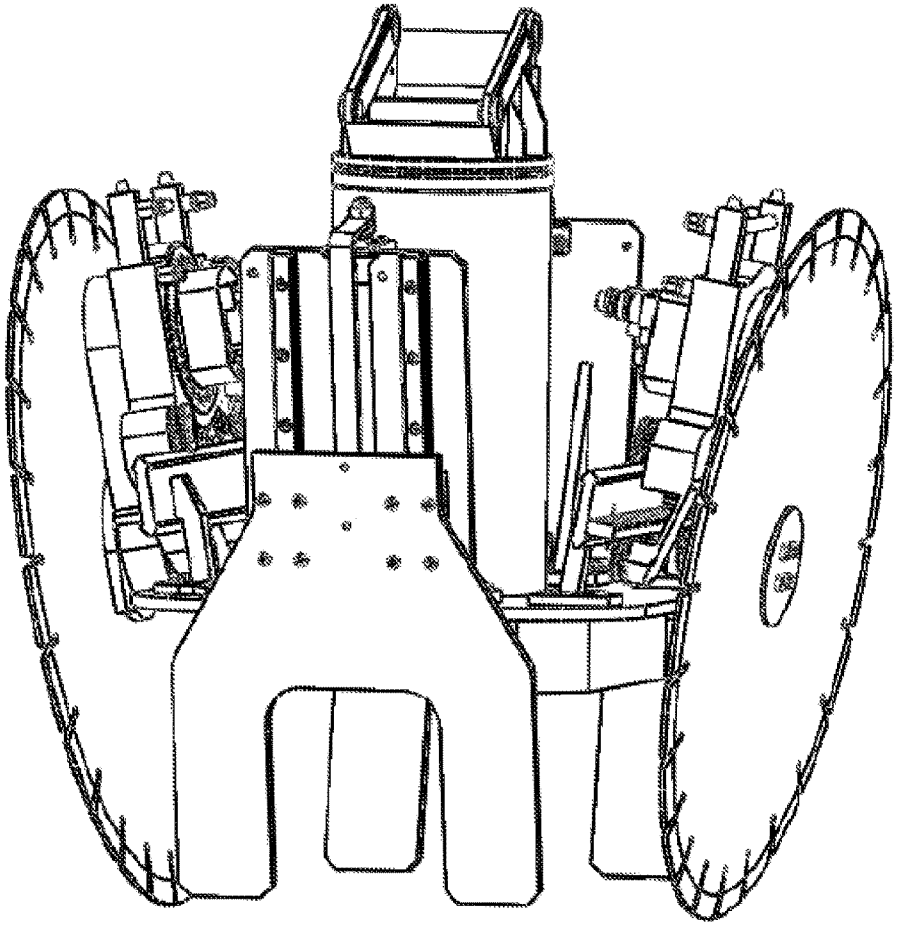
FIG. 10 is an operation view of the whole structure.

In the drawings above, 1 refers to diamond saw blade, 2 refers to claw hydraulic drive cylinder, 3 refers to hydraulic joint, 4 refers to rack, 5 refers to claw connector, 6 refers to claw, 7 refers to rotating platform, 8 refers to turntable, 9 refers to wall saws support frame, 10 refers to linear slider, 11 refers to hydraulic motor, 12 refers to hydraulic cantilever, 13 refers to wall saws mounting, 14 refers to guide roller, 15 refers to wall saws travel motor, 16 refers to wall saw hydraulic joint, 17 refers to spline, 18 refers to claw mounting bracket, 19 refers to hydraulic drive cylinder mounting bracket, 20 refers to claw arranging slider, 21 refers to claw linear guideway, and 22 refers to servo motor.

DETAILED DESCRIPTION OF THE PREFERRED EMBODIMENTS

The preferred embodiments will be described accompanied by appended drawing.

As shown in the figure, an integral rescue accessory for forcible entry and core drill may include hydraulic wall saws (A), a rotating platform, and a coring claw (B).

The hydraulic wall saws (A) may include: diamond saw blade (1), a wall saws support frame (9), a wall saws linear slider (10), a hydraulic motor (11), a hydraulic arm (12), a wall saws mounting (13), a wall saws guide roller (14), a wall saws travel motor (15), a wall saw hydraulic joint (16) and a spline (17). The diamond saw blade (1) is driven by a hydraulic motor (11) to proceed cutting down through swinging the hydraulic arm (12). The whole mainframe of hydraulic wall saws is installed on the linear slider (10), and it is driven by wall saws travel motor (15), guide roller (14) is guiding along the spline (17) to proceed straight-line cutting. Wall saws support frame (9) and wall saws mounting (13) are installed with a certain angle to make the angle between diamond saw blade (1) and cutting plane normal be 10°.

The rotating platform may include a general hydraulic joint (3), a rack (4), a rotating platform (7), a turntable (8) and a servomotor (22). The top of rack connects with a general hydraulic joint (3) configured to cut with a large-scale engineering equipment, and the bottom of rack connects with rotating platform (7).

The coring claw including a claw hydraulic drive cylinder (2), a claw connector (5), a claw (6), a claw mounting bracket (18), a hydraulic drive cylinder mounting bracket (19), a claw arranging slider (20), and a claw linear guideway (21). Two claw mounting brackets (18) are arranged on the turntable (8), and claw hydraulic drive cylinder (2) is arranged on two claw mounting brackets (18). Claw hydraulic drive cylinder (2) connects with a claw (6) through claw connector (5). The extension and recovery of the claw (6) are driven by telescoping of the hydraulic cylinder. Claw (6) is arranged on claw arranging slider (20) which can slide along the claw linear guideway (21). Claw mounting bracket (18) is designed with a certain angle which also makes the angle between claw (6) and cutting plane normal is 10° so that the claw can extend into the kerf to finish grabbing.

After completing cutting cut of one rectangular side by the hydraulic wall saw blade, the rotating platform rotates 90° to finish cutting on the other side. At the same time, the claw extends into the gap to hold the coring of concrete that had been cut. After all the cutting work is done, the saw blades are taken back through the cantilever. The coring of concrete is lifted by a mechanical arm of the large engineering machine, the claw is taken back, the coring of concrete slips off, and the entire process of drilling and coring is finished.

Rescue work is done by connecting hydraulic joint (3) with a hydraulic system of the engineering machine.

What is claimed is:

1. An integral rescue accessory for forcible entry, the accessory comprising:

hydraulic wall saws, a rotating platform, and a coring claw the hydraulic wall saws including: a diamond saw blade, a wall saws support frame, a wall saws linear slider, a hydraulic motor, a hydraulic arm, a wall saws mounting, a wall saws guide roller, a wall saws travel motor, a wall saw hydraulic joint and a spline, wherein:

the diamond saw blade is driven by the hydraulic motor to proceed cutting downwardly by swinging the hydraulic arm;

at least the hydraulic wall saws, the hydraulic motor, and the hydraulic arm are installed on the linear slider and are driven by the wall saws travel motor, the guide roller guides at least the hydraulic wall saws, the hydraulic motor, and the hydraulic arm along the spline to proceed straight-line cutting;

the wall saws support frame and the wall saws mounting are installed at a certain angle that makes the angle between the diamond saw blade and a cutting plane 80°;

the rotating platform including a general hydraulic joint, rack, a rotating platform, a turntable and a servomotor;

the top of the rack connects with the general hydraulic joint which is configured to connect to a large-scale engineering equipment, the bottom of the rack connects with the rotating platform;

the coring claw including a claw hydraulic drive cylinder, a claw connector, a claw, a claw mounting bracket, a hydraulic drive cylinder mounting bracket, a claw arranging slider, and a claw linear guideway; two claw mounting brackets are arranged on the turntable, the claw hydraulic drive cylinder is arranged on two claw mounting brackets, and the claw hydraulic drive cylinder connects with a claw via the claw connector;

an extension and recovery of the claw is driven by telescoping of the hydraulic cylinder; the claw is arranged on a claw arranging slider configured to slide along the claw linear guideway; and the claw mounting bracket is designed with a certain angle to make the angle between the claw and the cutting plane normal 80° such that the claw extends into a gap created by the hydraulic wall saws.

2. The accessory of claim 1, wherein the diamond saw blade and claw are arranged with an angle of 80° with the cutting plane, and an oblique plane is formed by through-cutting to prevent falling of a concrete block cut by the hydraulic wall saws and to allow coring by the claw.

3. The accessory of claim 1, wherein the diamond saw blade is configured to cut reinforced concrete ruins to prevent significant impact and shake, and a rectangular exit is cut by means of integral rotation of the cutting saw blade.

4. The accessory of claim 1, wherein two saws are symmetrically distributed to improve simultaneousness and working efficiency, and unbalanced force and torque are reduced due to a high degree of symmetry of the accessory.

5. The accessory of claim 1, wherein the hydraulic joint connects with an engineering machinery hydraulic system.

* * * * *